United States Patent [19]

Keever, Jr.

[11] 4,240,211

[45] Dec. 23, 1980

[54] DISH DRYING APPARATUS

[75] Inventor: Charles W. Keever, Jr., Laurel, Mont.

[73] Assignees: Robert Mace; Mike Mace, both of Laurel, Mont. ; part interest to each

[21] Appl. No.: 32,395

[22] Filed: Apr. 23, 1979

[51] Int. Cl.[3] ..... F26B 19/00

[52] U.S. Cl. ..... 34/90; 34/197; 312/236; 312/245

[58] Field of Search ..... 34/88, 90, 107, 195, 34/197, 237, 238, 239, 82; 312/236, 245

[56] References Cited

U.S. PATENT DOCUMENTS

| | | | |
|---|---|---|---|
| 1,982,255 | 11/1934 | Knoll | 34/82 |
| 2,328,129 | 8/1943 | Earle | 34/197 X |
| 2,549,106 | 4/1951 | Manacher | 34/90 |
| 2,641,679 | 6/1953 | Brodbeck | 34/90 X |
| 3,280,896 | 10/1966 | Goodson et al. | 34/90 X |
| 3,367,044 | 2/1968 | Fitch | 34/197 |
| 3,786,575 | 1/1974 | Riblett | 34/90 X |
| 3,878,621 | 4/1975 | Duerre | 34/90 |

FOREIGN PATENT DOCUMENTS

| | | | |
|---|---|---|---|
| 927598 | 5/1955 | Fed. Rep. of Germany | 34/195 |
| 1951195 | 4/1971 | Fed. Rep. of Germany | 34/197 |
| 1964289 | 6/1971 | Fed. Rep. of Germany | 34/197 |

*Primary Examiner*—Albert J. Makay
*Assistant Examiner*—Harold Joyce
*Attorney, Agent, or Firm*—Arthur L. Urban

[57] ABSTRACT

A dish drying apparatus including a dishholding member, a housing disposed above the dishholding member, a plurality of outlet openings in the face of the housing adjacent to the dishholding member, a plurality of inlet openings in another face of the housing, duct member connecting the outlet openings in the face of the housing adjacent to the dishholding member with the inlet openings in another face of the housing, air transferring mechanism disposed along the length of the duct member, heating mechanism disposed in the duct member for heating air being transferred therethrough, electrical drive mechanism for the air transferring mechanism, activating mechanism for the electrical drive mechanism and the heating mechanism, housing support mechanism in a face other than a face adjacent to the dishholding member.

3 Claims, 4 Drawing Figures

DISH DRYING APPARATUS

This invention relates in a novel dish drying apparatus and more particularly relates to a new apparatus for the drying of dishes after washing.

One of the household tasks which is considered to be a chore by most people is "doing the dishes". In households which include children, drying dishes is one of their assigned tasks. In order to get children to do this job, parents often have to threaten, cajole, bribe or in other ways apply pressure to their children. Even when a parent succeeds in convincing a child to do the work, the child still does not have a genuine interest in doing the job well, and an inspection of the finished dishes frequently shows less than satisfactory results.

As a result of these problems, parents often give up in their efforts to have their children do the dishes and either do them themselves with reluctance or purchase an automatic dishwasher. However, in some cases neither of these solutions provides a satisfactory answer to the dishdrying problem. When parents do the dishes themselves, it takes time from other activities which may be of higher priority. In addition, the children seeing their parents doing the dishes may develop less respect for them and this may adversely affect their relationship in other areas.

The purchase of an automatic dishwasher ordinarily involves a considerable investment which may necessitate the placement of limitations on other portions of the family budget. Another factor in the purchasing of an automatic dishwasher is the energy required in its operation. Not only are there electrical power requirements for the pump but more importantly the large amount of power required for the drying step. From the above discussion it is clear that present ways of doing dishes do not provide an ideal solution for the different problems encountered by the various living styles.

The present invention provides a novel dish drying apparatus which offers an alternative to present forms of doing the dishes which heretofore was not available. The dish drying apparatus of the invention provides an inexpensive means for alleviating the drudgery of dishdrying. The dish drying apparatus eliminates hand drying and the problems associated with allowing dishes to dry themselves. Furthermore, the dish drying apparatus of the invention is simpler to use, than an automatic dishwasher and must less complex to service. In addition, the design of the apparatus allows the use of various accessories to perform functions which ordinarily are not associated with dishwashing. Moreover, the dish drying apparatus of the invention is simple in design and can be fabricated from commercially available components and materials. The fabrication may be accomplished by using known metal working techniques and procedures.

Other benefits and advantages of the novel dish drying apparatus of the present invention will be apparent for the following description and accompanying drawings.

Figure 1:
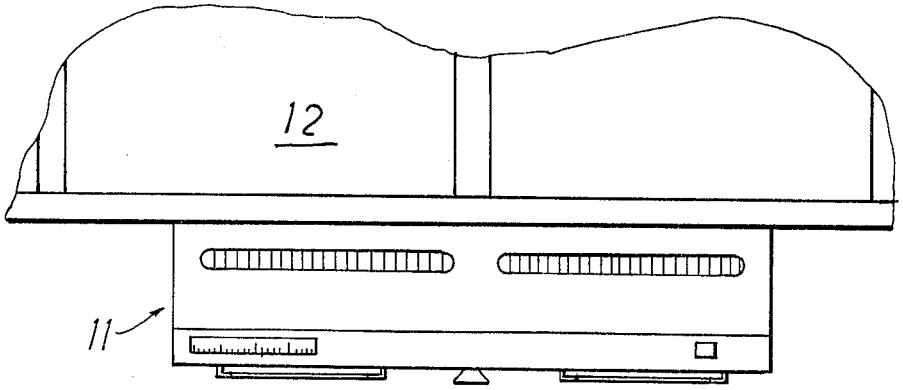
FIG. 1 is a schematic illustration of one form of the dish drying apparatus of the invention as installed in a kitchen.

As shown in the drawings, the dish drying apparatus is mounted under an overhead kitchen cabinet 12. The dish drying apparatus is positioned so that it is located above a portion of a counter 13 of a lower cabinet 14.

Figure 2:
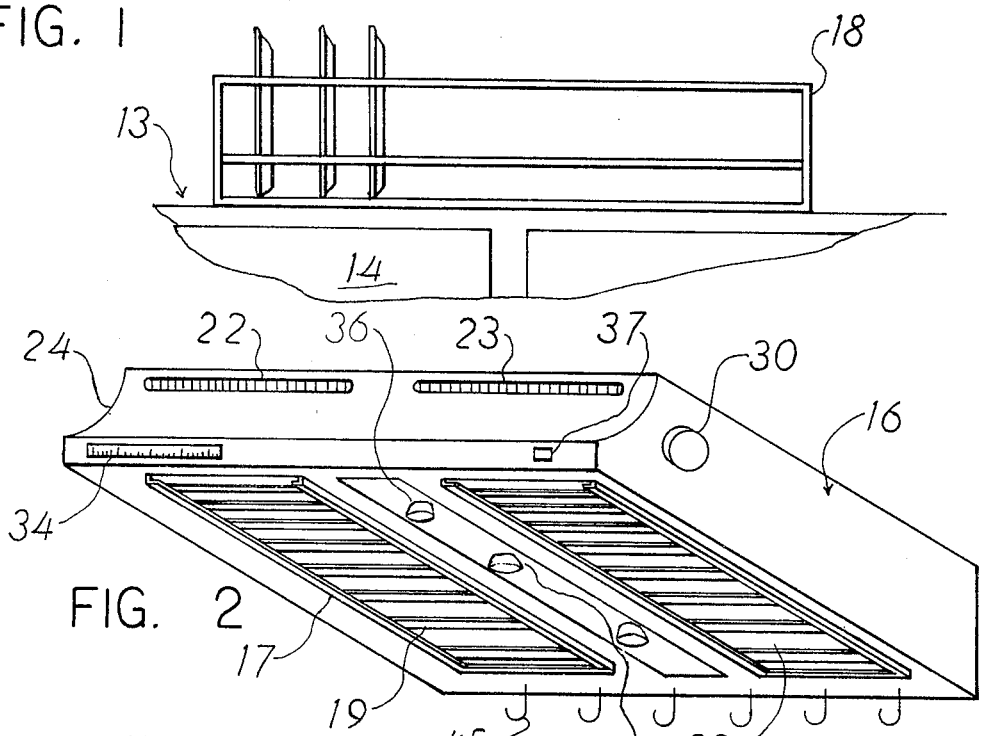
FIG. 2 is an enlarged view in perspective of the dish drying apparatus shown in FIG. 1.

The dish drying apparatus as shown in greater detail in FIG. 2 includes a housing 16 with a plurality of outlet openings in the lower face 17 thereof which is adjacent to a dishholding means such as rack 18. Adventageously, the plurality of outlet openings are formed by grill sections 19 and 20 located in the lower face 17.

Figure 3:
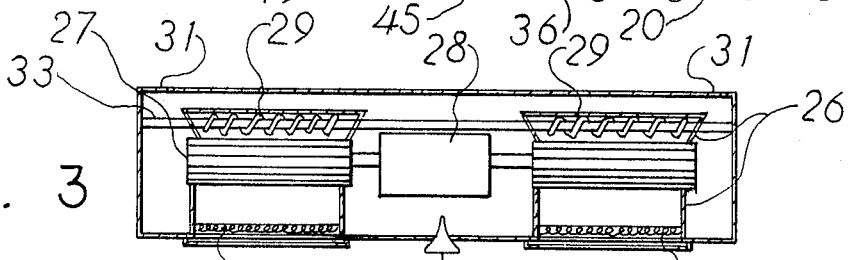
FIG. 3 is a sectional view of the dish drying apparatus shown in FIG. 2.

A plurality of inlet openings also are located in another face of the housing 16. As shown, these openings are formed by grill sections 22 and 23 located in the front panel 24 of housing 16. Duct 26 as shown in FIG. 3 connects the grill sections 19 and 20 with the grill sections 22 and 23.

Air transferring means is disposed along the length of duct 26. FIG. 3 shows the air transferring means as a fan 27 which is driven by electrical drive means such as motor 28. Heating means, advantageously heating coil 29, also is positioned in duct 26 for heating air being transferred therethrough by fan 27. The motor 28 and heating coil 29 are powered by activating means such as switch 30.

The dish drying apparatus is affixed to the cabinet through housing support means in a face of the housing other than the face adjacent to the dish holder 18. As shown, the housing may be supported through the use of suitable fasteners disposed through openings 31 in the upper face of the housing.

The dish drying apparatus of the invention also may include a number of accessories. The accessories can serve one or more functions such as a thermostatic control 33 for the heating coil 29. Also the apparatus may include a timer 34 located in a face of a housing as shown in FIG. 2. It is desirable that light emitting means such as lamps 36 be included in the apparatus. These lamps shown as being disposed adjacent to outlet grill sections 19 and 20 may be activated by a switch 37 in one of the faces of the housing. In addition, the dish drying apparatus may include cup hooks 45 for decorative or utilitarian purposes. The employment of filters 46 in ducts 26 also is advantageous.

Figure 4:
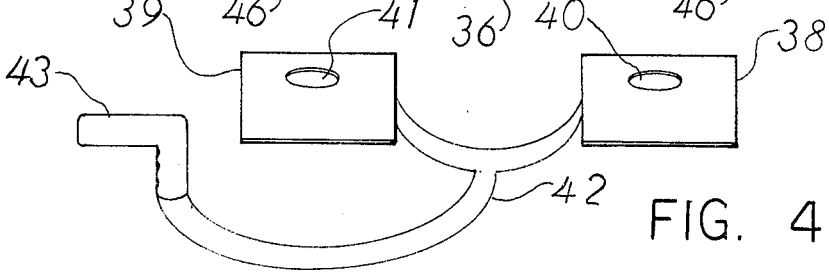
FIG. 4 is a schematic illustration of a hair drying accessory for the dish drying apparatus shown in FIGS. 1 and 2.

FIG. 4 illustrates a hair drying accessory which can be employed with the dish drying apparatus of the invention. The hair drying assembly includes cover means 38 and 39 which fit over the grill sections 19 and 20. The covers 38 and 39 have openings therein 40 and 41 respectively to which are connected flexible tubing 42. Tubing 42 has an air directing handle 43.

The dish drying apparatus 11 of the invention as shown in the drawings is mounted for use under an overhead kitchen cabinet 12 with suitable fasteners (not shown) extending through openings 31 in the upper face of the housing 16 of the apparatus. In use, dishes which have been washed are placed in rack 18 which is positioned below the dish drying apparatus 11. The apparatus is started by activating switch 30 which energizes motor 28 and heating coil 29. Energizing motor 28 causes fan 27 to rotate which draws air into inlet grill sections 22 and 23 and through duct 26. The air moving through duct 26 passes coil 29 and is thereby heated prior to being discharged from outlet grill sections 19 and 20. The air from the grill sections 19 and 20 is directed against the dishes in rack 18 to provide a simple and quick drying thereof.

The above description and the accompanying drawings show that the present invention provides a novel dish drying apparatus which alleviates the drudgery of hand dish drying. The dish drying apparatus of the invention offers an inexpensive alternative to further drying of dishes. The dish drying apparatus is much simpler in design and in operation than the drying mechanism of an automatic dishwasher. The dish drying apparatus of the invention performs functions which ordinarily are not associated with other dish drying methods. For example, the dish drying apparatus may be used in the drying of a variety of articles, including hands, polished fingernails and other objects such as lingerie, sweaters and the like. Also the dish drying apparatus may be used for the defrosting of frozen foods, etc. It may be desirable under some conditions to employ a curtain or shroud with the dish drying apparatus to enclose the articles being dried and thereby improving the efficiency of the drying operation.

It will be apparent that various modifications can be made in the particular dish drying apparatus described in detail above and shown in the drawings within the scope of the invention. For example, the size and configuration of the various components may be changed to meet specific requirements. In addition, the apparatus may be constructed from widely different materials such as metals, wood, fiberglass or other plastics and the like. Also, the heating coil may be electrically or fluid heated or may be a heat lamp. Furthermore, the dish drying apparatus of the invention may be mounted permanently or can be a portable appliance as desired. Therefore, the scope of the invention is to be limited only by the following claims.

What is claimed is:

1. Dish drying apparatus attached to the bottom of a cabinet located above a counter surface, said dish drying apparatus including a housing disposed above dishholding means, said housing including a top face, a bottom face and a plurality of side faces, housing support means connecting said top face of said housing with said bottom of said cabinet, a plurality of outlet openings in the bottom face of said housing remote from said cabinet, a plurality of inlet openings in a side face of said housing, duct means connecting said outlet openings in the bottom face of said housing with said inlet openings in said side face of said housing, rotatable fan means disposed along the length of said duct means, filter means associated with said duct means, heating means disposed in said duct means for heating air being transferred therethrough, thermostatic control means associated with said heating means, electrical drive means for said rotatable fan means, switch means for said electrical drive means and said heating means, and timing means associated with said switch means.

2. Dish drying apparatus according to claim 1 including light emitting means in the face of said housing adjacent to said dishholding means.

3. Dish drying apparatus according to claim 1 including removable cover means for said outlet openings and flexible tube means connectable to said removable cover means, and air directing means at the end of said flexible tube means.

* * * * *